US011180836B2

(12) United States Patent
Zhao et al.

(10) Patent No.: US 11,180,836 B2
(45) Date of Patent: Nov. 23, 2021

(54) LOW-YIELD-RATIO HIGH-STRENGTH-TOUGHNESS THICK STEEL PLATE WITH EXCELLENT LOW-TEMPERATURE IMPACT TOUGHNESS AND MANUFACTURING METHOD THEREFOR

(71) Applicant: BAOSHAN IRON & STEEL CO., LTD., Shanghai (CN)

(72) Inventors: Sixin Zhao, Shanghai (CN); Liandeng Yao, Shanghai (CN); Xiaobo Wang, Shanghai (CN); Xiaoting Zhao, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 200 days.

(21) Appl. No.: 15/559,049

(22) PCT Filed: Dec. 8, 2015

(86) PCT No.: PCT/CN2015/096636
§ 371 (c)(1),
(2) Date: Sep. 17, 2017

(87) PCT Pub. No.: WO2016/150196
PCT Pub. Date: Sep. 29, 2016

(65) Prior Publication Data

US 2018/0073116 A1 Mar. 15, 2018

(30) Foreign Application Priority Data

Mar. 20, 2015 (CN) ..... 201510125485.1

(51) Int. Cl.

| | |
|---|---|
| ***C22C 38/58*** | (2006.01) |
| ***C22C 38/50*** | (2006.01) |
| ***C22C 38/20*** | (2006.01) |
| ***C21D 8/02*** | (2006.01) |
| ***C22C 38/24*** | (2006.01) |
| ***C21D 1/18*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/48*** | (2006.01) |

(52) U.S. Cl.

CPC ..... *C22C 38/58* (2013.01); *C21D 1/18* (2013.01); *C21D 8/02* (2013.01); *C21D 8/0226* (2013.01); *C21D 8/0247* (2013.01); *C21D 9/46* (2013.01); *C22C 38/001* (2013.01); *C22C 38/02* (2013.01); *C22C 38/06* (2013.01); *C22C 38/20* (2013.01); *C22C 38/24* (2013.01); *C22C 38/44* (2013.01); *C22C 38/48* (2013.01); *C22C 38/50* (2013.01); *C21D 2211/001* (2013.01); *C21D 2211/008* (2013.01)

(58) Field of Classification Search

CPC ..... C22C 38/02; C22C 38/06; C22C 38/44; C22C 38/48; C22C 38/50; C22C 38/58; C21D 2211/008; C21D 2211/001

See application file for complete search history.

(56) References Cited

U.S. PATENT DOCUMENTS

| | | | | |
|---|---|---|---|---|
| 4,008,103 | A * | 2/1977 | Miyoshi | C21D 8/0226 148/653 |
| 6,517,955 | B1 * | 2/2003 | Takada | C21D 8/0278 148/522 |
| 2014/0377584 | A1 * | 12/2014 | Hasegawa | C22C 38/001 428/659 |
| 2015/0299831 | A1 * | 10/2015 | Sato | C22C 38/50 148/326 |

FOREIGN PATENT DOCUMENTS

| | | | |
|---|---|---|---|
| GN | 101328564 | A | 12/2008 |
| GN | 104789892 | A | 7/2015 |
| JP | H05222450 | A | 8/1993 |
| JP | H05222453 | A | 8/1993 |
| JP | H05230530 | A | 9/1993 |
| JP | H09271830 | A | 10/1997 |
| JP | 2001323336 | A | 11/2001 |
| JP | 3817087 | B2 | 8/2006 |
| JP | 2008075107 | A | 4/2008 |
| JP | 2014118579 | A | 6/2014 |

OTHER PUBLICATIONS

JP-2001323336-A translation (Year: 2001).*
Japanese Office Action dated Sep. 25, 2018 in co-pending Japanese Patent Application No. 2017-0549212 filed Dec. 8, 2015.
PCT/CN2015/096636 International Search Report and Written Opinion, dated Mar. 14, 2016.

* cited by examiner

*Primary Examiner* — Anthony J Zimmer
*Assistant Examiner* — Sean P. O'Keefe
(74) *Attorney, Agent, or Firm* — Lei Fang; Smith Tempel Blaha LLC

(57) ABSTRACT

Provided is a low-yield-ratio high-strength-toughness thick steel plate with excellent low-temperature impact toughness, which comprises: 0.05%-0.11% of C, 0.10%-0.40% of Si, 1.60%-2.20% of Mn, S≤0.003%, 0.20-0.70% of Cr, 0.20%-0.80% of Mo, 0.02%-0.06% of Nb, 3.60%-5.50% of Ni, 0.01%-0.05% of Ti, 0.01%-0.08% of Al, 0<N≤0.0060%, 0<O≤0.0040%, and 0<Ca≤0.0045%, with the balance being Fe and inevitable impurities; in addition, Ni+Mn≥5.5 is also satisfied. The manufacturing method for the above-mentioned steel plate comprises smelting, casting, heating, two-stage rolling, quenching, cooling after quenching, and tempering.

13 Claims, No Drawings

LOW-YIELD-RATIO HIGH-STRENGTH-TOUGHNESS THICK STEEL PLATE WITH EXCELLENT LOW-TEMPERATURE IMPACT TOUGHNESS AND MANUFACTURING METHOD THEREFOR

CROSS-REFERENCE TO RELATED APPLICATIONS

This application is a 371 U.S. National Phase of PCT International Application No. PCT/CN2015/096636, filed on Dec. 8, 2015, which claims benefit and priority to Chinese patent application No. 201510125485.1, filed on Mar. 20, 2015. Both of the above-referenced applications are incorporated by reference herein in their entirety.

TECHNICAL FIELD

The present invention relates to a thick steel plate and its manufacturing method, and particularly relates to a high-strength-toughness thick steel plate and a manufacturing method for the high-strength-toughness thick plate.

BACKGROUND ART

Steel plates for engineering machinery, coal mine machinery, harbour machinery and bridges usually need to have a good strength toughness, so as to have an ability of maintaining a stable working condition when achieving structural forces and shock loads. In order to ensure the safety and stability of steels for large machinery, submersible vehicles and bridges, the selection of a steel plate is generally carried out based on a yield strength divided by a certain safety factor. The ratio of the yield strength to the tensile strength is termed as a yield ratio. In engineering applications, the yield ratio is principally embodied by a safety factor in a course which begins from the yielding of a steel plate to its complete failure when a steel structure is subject to an ultimate stress surpassing the yield strength. Where the yield ratio of a steel plate is lower, the steel plate when subjecting to a stress higher than the yield strength has a wider safety range before the stress reaches the tensile strength and causes the material to break or the structure to lose stability. Where the yield ratio of a steel plate is too high, the steel plate reaches the tensile strength quickly and is broken once the stress arrives at the yield strength. Therefore, in cases where the requirements for steel structure safety are high, steel plates with a lower yield strength are required. If a steel plate is used for the construction of equipment and structures used in extremely cold areas in the high latitudes, the steel plate needs to further have a good low temperature impact toughness at an extremely cold temperature (−80° C.) so as to avoid the occurrence of brittle failure to the equipment when being impacted, in addition to having a high strength. Moreover, in order to ensure the safety of a steel structure at an extremely cold temperature and in situations of high performance requirements, a steel having both a high strength and a low yield ratio is required.

Where the yield phenomenon of a steel plate is obvious, an upper yield strength and a lower yield strength are used for the yield strength; and where the yield phenomenon of steel plate is not obvious, a strength $Rp_{0.2}$ at 0.2% of plastic deformation is used as the yield strength. The upper yield strength of a low carbon steel plate results from Cottrell atmosphere formed by interstitial atoms near dislocations, which impedes start of the movement of the dislocations.

Once the dislocations begin to move, the effect of the Cottrell atmosphere vanishes, and the force required to be applied on the steel plate is reduced, so as to form a lower yield. If the start of the movement of the dislocations involves interactions between Cottrell atmosphere, dislocation rings and dislocation walls, the yielding phenomenon will not be obvious. A yield strength represents a stress that broadens slip bands due to large-scale dislocation multiplication and movement. It is considered in the prior art that a yield strength corresponds to a stress that causes all movable edge dislocations to slip out of crystals. Tensile strength is the maximum stress that a material can resist during drawing, often accompanied with the nucleation, growth and propagation of microcracks. When the strength of a steel plate is increased, the energy absorbed by the steel plate when subjected to an impact is lower due to a refined structure and a high dislocation density, leading to a decrease in the toughness of such a steel plate. Moreover, since the strength of the steel plate is higher, it is difficult to effectively reduce the yield ratio to 0.8 or lower.

A Chinese patent document with Publication No. CN 103352167 A, published on Oct. 16, 2013, entitled "low-yield ratio and high-strength steel for bridges and the manufacturing method thereof", discloses a steel for bridges. The steel for bridges disclosed in the patent document has the following chemical components in percentage by weight (wt. %): 0.06-0.10% of C, 0.20-0.45% of Si, 1.20-1.50% of Mn, P≤0.010%, S≤0.0020%, 0.30-0.60% of Ni, 0.20-0.50% of Cu, 0.15-0.50% of Mo, 0.025-0.060% of Nb, Ti≤0.035%, 0.020-0.040% of Alt, and the balance being Fe and inevitable impurities. The microstructure of the steel for bridges disclosed in the patent document is bainite+ferrite+pearlite.

A Chinese patent document with Publication No. CN 103103452 A, published on May 15, 2013, entitled "low-yield ratio, high-strength and high-toughness steel for low temperature use and a preparation method thereof", discloses a high-toughness steel and a preparation method thereof. The high-toughness steel has the following chemical components in percentage by mass (wt. %): 0.05-0.10 of C, 0.15-0.35 of Si, 1.0-1.8 of Mn, P<0.014, S<0.001, 0.03-0.05 of Nb, 0.0012-0.02 of Ti, 0.5-1.0 of Ni, 0.1-0.4 of Cr, 0.5-1.0 of Cu, 0.1-0.5 of Mo, 0.001-0.03 of Alt, and the balance being Fe and trace impurities. The microstructure of the high-toughness steel disclosed in the patent document is fine bainite+ferrite, and further comprises a microstructure of retained austenite film.

A Chinese patent document with Publication No. CN 101676427 A, published on Mar. 24, 2010, entitled "high-strength low-yield ratio steel plate", relates to a high-strength low-yield ratio steel plate, and the steel plate has the following chemical components in percentage by mass (wt. %): 0.15-0.20% of C, 1.0-2.0% of Si, 1.8-2.0% of Mn, Al≤0.036%, 0.05-0.1% of V, P≤0.01%, S≤0.005%, 0.8-1.0% of Cr, and the balance being Fe and inevitable impurities. The microstructure of the steel plate is fine bainite+martensite.

SUMMARY OF THE INVENTION

An object of the present invention lies in providing a low-yield ratio high-strength-toughness thick steel plate with excellent low temperature impact toughness, which has a larger tensile strength, a yield strength and an elongation and a smaller yield ratio and has a good low temperature toughness. Thus, the steel plate of the present invention has both good a high-strength-toughness and a low yield ratio.

In order to achieve the above-mentioned object, the present invention provides a low-yield ratio high-strength-toughness thick steel plate with excellent low temperature impact toughness, wherein the contents in percentage by mass of chemical elements of the thick steel are:

0.05-0.11% of C,
0.10-0.40% of Si,
1.60-2.20% of Mn,
S≤0.003%;
0.20-0.70% of Cr,
0.20-0.80% of Mo,
0.02-0.06% of Nb,
3.60-5.50% of Ni,
0.01-0.05% of Ti,
0.01-0.08% of Al,
0<N≤0.0060%,
0<O≤0.0040%,
0<Ca≤0.0045%, and the balance being Fe and inevitable impurities;

furthermore, the elements Ni and Mn further satisfy Ni+Mn≥5.5.

The principle of the design of the chemical elements in the low-yield ratio high-strength-toughness thick steel plate with excellent low temperature impact toughness of the present invention is as follows:

C: The variation of the addition amount of C element in the steel can cause the type of phase transformation that occurs to the steel plate to be different. If the contents of C element and alloy elements are lower, diffusive phase transformation such as ferrite transformation, pearlite transformation will occur. If the contents of C element and alloy elements are higher, martensite phase transformation will occur. The increase of C atoms can increase the stability of austenite; however, if the content of C element is too high, the ductility and toughness of the steel plate will be reduced. In the process of direct quenching, an excessive low content of C cannot form a structure having a high strength in the steel plate. With the effect of C element on both the strength toughness and strength ductility of the steel plate, the C content in the chemical elements in the low-yield ratio high-strength-toughness thick steel plate with excellent low temperature impact toughness of the present invention should be controlled at 0.05 wt. %≤C≤0.11 wt. %.

Si: A Si element added to the steel improves the strength of the steel plate by means of atom replacement and solution strengthening; however, an excessively high Si content can increase a tendency of hot cracking during steel plate welding. In this regard, the Si content in the low-yield ratio high-strength-toughness thick steel plate with excellent low temperature impact toughness of the present invention should be controlled between 0.10 wt. % and 0.40 wt. %.

Mn: Mn improves the strength toughness of the steel plate by means of solid solution strengthening. Moreover, Mn is an austenite-stabilizing element, and is conducive to the expansion of the austenite phase area. In the technical solution of the present invention, the combined addition of Ni, Mn and C and the control of the austenite phase area in the tempering process cause the steel plate to form reversed austenite during tempering. In the meanwhile, Mn element in the martensite further improves the tensile strength. A duplex phase structure of reversed austenite and martensite can effectively reduce the yield ratio of the steel plate. As a result, based on the technical solution of the present invention, the content in percentage by mass of Mn element in the steel plate should be set to 1.60-2.20%, thereby adjusting the yield ratio and strength toughness of the steel plate.

S: S can form sulphides in the steel, which can reduce the low temperature impact toughness of the steel plate. In the steel plate of the present invention, an S element is an impurity element that needs to be controlled, and the sulphides can be spheroidized using a calcification treatment, so as to reduce the effect S on the low temperature impact toughness. With regard to the low-yield ratio high-strength-toughness thick steel plate with excellent low temperature impact toughness of the present invention, the S content does not exceed 0.003 wt. %.

Cr: Cr can improve the hardenability of the steel plate and allow a formation of martensite structure during the cooling of the steel plate. An excessively high Cr content can increase the carbon equivalent of the steel plate and deteriorate the weldability. Considering the thickness factor of the steel plate, there is a need for the addition of an appropriate amount of Cr, and in this regard, the Cr content in the low-yield ratio high-strength-toughness thick steel plate with excellent low temperature impact toughness of the present invention should be controlled at 0.20-0.70 wt. %.

Mo: Mo can effectively inhibit the diffusive phase transformation, leading to the formation of a higher strength, low temperature transformation structure during the cooling of the steel plate. If the Mo content is too low, the effect of inhibiting the diffusive phase transformation of the steel plate cannot be fully exerted, such that more martensite structure cannot be obtained during the cooling of the steel plate, thus leading to a decrease in the strength of the steel plate. If the content of Mo is excessively high, the carbon equivalent will be increased, leading to deteriorated welding performance. Considering the thickness factor of the steel plate, the Mo content in the steel plate needs to be controlled at 0.20-0.80 wt. %.

Nb: Nb added into steel may inhibit the grain boundary motion of austenite, leading to the occurrence of the recrystallization to the steel plate at a higher temperature. When austenization is performed at a higher temperature, Nb which is solid dissolved in austenite will form NbC particles at dislocations and grain boundaries due to a strain-induced precipitation effect during rolling, thus inhibiting the grain boundary motion and improving the strength toughness of the steel plate. However, once the Nb content is too high, coarse NbC may be formed, leading to a deteriorated low temperature impact resistance of the steel plate. Therefore, the content of Nb added to the high-strength-toughness thick steel plate of the present invention should be controlled at 0.02-0.06 wt. %, so as to effectively control the mechanical properties of the steel plate.

Ni: Ni can form a solid solution with Fe in steel, and improve the toughness of the steel plate by means of reducing the stacking fault energy of lattice. In order to obtain a high-strength-toughness thick steel plate having a good low temperature toughness, a certain amount of Ni needs to be added into the steel plate. Ni can improve the stability of austenite, leading to the formation of martensite and residual austenite structures during cooling of the steel plate, so as to reduce the yield ratio. Nevertheless, the increase of the Ni content makes it possible to form a reversed austenite structure in the steel plate during tempering, and the reversed austenite and martensite can reduce the yield ratio of the steel plate. In this regard, the Ni content in the low-yield ratio high-strength-toughness thick steel plate with excellent low temperature impact toughness of the present invention should be controlled between 3.60 wt. % and 5.50 wt. %.

Ti: Ti can form titanium nitrides in molten steel, and subsequently forms oxides and carbides in a range of lower temperatures. However, an excessively high Ti content can result in the formation of coarse TiN in the molten steel. TiN particles are cubic, and stress concentration tends to occur at corners of the particles which are referred to as crack formation sources. With the comprehensive consideration of the effect of the addition of Ti to the steel plate, the Ti content in the low-yield ratio high-strength-toughness thick steel plate with excellent low temperature impact toughness of the present invention should be controlled in a range of 0.01-0.05 wt. %.

Al: Al added to steel refines grains by means of the formation of oxides and nitrides. In order to improve the toughness of the steel plate and ensure its welding performance, the content of Al in the low-yield ratio high-strength-toughness thick steel plate with excellent low temperature impact toughness of the present invention should be controlled at 0.01-0.08 wt. %.

N: In the technical solution of the present invention, N is an addition element that needs to be controlled. N can form nitrides with Ti and Nb. In the process of austenization, undissolved nitrides in the steel plate can obstruct the grain boundary motion of austenite, achieving the effect of refining austenite grains. If an N element content is too high, N and Ti will form coarse TiN, leading to a deterioration in the mechanical properties of the steel plate. In the meanwhile, N atoms can further gather at defects in the steel, to form pinholes and looseness. Therefore, the N content should be controlled at $0<N\leq0.0060$ wt. %.

O: O forms oxides with Al, Si and Ti in steel. During the austenization of a steel plate under heating, Al oxides can inhibit the growth of austenite, thus having a function of refining grains. Nevertheless, a steel plate having a greater O content has a tendency of hot cracking during welding, and therefore the content of O in the low-yield ratio high-strength-toughness thick steel plate with excellent low temperature impact toughness needs to be controlled at $0<O\leq0.0040$ wt. %.

Ca: Ca added into steel can form CaS, and functions to spheroidize sulphides, leading to an improvement in the low temperature impact toughness of the steel plate. Therefore, the content of Ca in the high-strength-toughness thick steel plate of the present invention should be controlled at $0<Ca\leq0.0045$ wt. %.

In the technical solution of the present invention, N, O and Ca are all addition elements that need to be controlled.

In this technical solution, the inevitable impurities mainly include a P element, and the lower the P element content, the better.

Besides, the contents of the Ni element and Mn element in the low-yield ratio high-strength-toughness thick steel plate with excellent low temperature impact toughness of the present invention need to further satisfy $Ni+Mn\geq5.5$ wt. %.

In order to ensure the formation of reversed austenite of the steel plate after tempering, so as to effectively expand the difference between the yield strength and tensile strength and reduce the yield ratio, the total amount of Ni and Mn in the steel plate needs to be defined. Both Ni and Mn can expand the austenite phase area, causing the tempering temperature of the resulting austenite to decrease. The contribution of Mn to the strength of the steel plate is higher than that of Ni to the strength of the steel plate. In the case of requiring an ultra-low yield ratio and a higher strength toughness upon the comprehensive consideration of the mechanical properties of the thick steel plate, the total amount of Ni and Mn needs to further reach 5.5 wt. % or higher in addition to the fact that the above-mentioned Ni and Mn elements need to comply with the respective component definitions.

Further, in the low-yield ratio high-strength-toughness thick steel plate with excellent low temperature impact toughness of the present invention, Ti and N need to further satisfy $Ti/N\geq3.0$.

The Ti and N alloy elements need to satisfy the following conditions: $Ti/N\geq3.0$, because Ti and N can precipitate in the liquid phase, leading to the formation of square TiN. When the TiN particles are too large, the fatigue properties of the steel plate can be affected. And when the content of TiN is less, the inhibition effect on the growth of austenite grains is not obvious.

Further, in the low-yield ratio high-strength-toughness thick steel plate with excellent low temperature impact toughness of the present invention, Ca and S need to further satisfy $1.2\leq Ca/S\leq3.5$.

The content of Ca usually needs to be controlled according to $ESSP=(Ca\ wt\ \%)*[1-1.24(O\ wt\ \%)]/1.25(S\ wt\ \%)$, wherein the ESSP is a sulphide inclusion shape control index and appropriately in a range of 0.5-5. The calcium-sulphur ratio needs to be controlled, and with regard to the technical solution of the present invention, Ca and S elements should satisfy $1.2\leq Ca/S\leq3.5$.

Further, the low-yield ratio high-strength-toughness thick steel plate with excellent low temperature impact toughness of the present invention further has at least one of 0.01-0.10 wt. % of V and 0.50-1.00 wt. % of Cu.

V added to steel can improves the strength toughness of the steel plate by means of solid solution strengthening and the precipitation strengthening effect of MC-type carbides. However, where the content of the V element is excessively high, the MC-type carbides may be coarsened during the thermal treatment, affecting the low temperature toughness. In order to ensure the mechanical properties of the steel plate, the V element content in the low-yield ratio high-strength-toughness thick steel plate with excellent low temperature impact toughness of the present invention needs to be controlled at $0.01\ wt.\ \%\leq V\leq0.10$ wt. %.

Cu added in steel can be formed as fine ε-Cu during cooling and tempering, which inhibits the dislocation movement, thereby increasing the strength of the steel plate; furthermore, the Cu added in steel does not affect the toughness of the steel plate. However, in the addition of Cu into steel, since the melting point of Cu is about 1083° C., the Cu content needs to be controlled at 0.50-1.00 wt. % in order to avoid the dissolution of Cu into grain boundaries during heating.

Furthermore, in the case of having V element, C, Nb and V in the low-yield ratio high-strength-toughness thick steel plate with excellent low temperature impact toughness of the present invention need to further satisfy $0.45*C\leq Nb+V\leq1.55*C$ ("*" represents "multiplied by").

Nb and V can form carbides during cooling and tempering. If the content of C is too high, coarse Nb and V carbides can be formed, whereby the low temperature impact toughness of the steel plate at −84° C. can be significantly deteriorated. If the content C is too low, the resulting dispersed carbides are less, and the strength of the steel plate can be reduced. Nb has an effect on inhibiting the recrystallization of the steel plate, reducing the thickness and improving the mechanical properties of the steel plate. Comprehensively considering the effects of Nb and V on the toughness of the steel plate, the relationship between C, Nb and V needs to satisfy: 0.45*C≤Nb+V≤1.55*C so as to ensure the matching of the strength toughness of the steel plate.

Furthermore, in the case of having Cu element, Ni, Mn and Cu in the low-yield ratio high-strength-toughness thick steel plate with excellent low temperature impact toughness of the present invention need to further satisfy Ni≥1.45(Mn+Cu).

The melting point of Cu is about 1083° C., Cu in steel may be melted when heated, thereby resulting in problems such as poor steel surface quality and internal cracking. In order to avoid the effect of Cu on the quality of the steel plate, a certain content of Ni needs to be added. An excessively high content of Mn can form coarse MnS particles, reducing the low temperature toughness of the steel plate. For the purpose of improving the low temperature toughness of the steel plate, a certain amount of Ni needs to be added as a supplement. Comprehensively considering the effects of Mn and Cu and the matching relationship between the two elements and Ni, the content of Ni satisfying Ni≥1.45(Mn+Cu) needs to be ensured.

In the technical solution of the present invention, a composition system of high Ni, high Mn and low C is used; moreover, the technical solution of the present invention further defines the total amount of Ni+Mn, the composition relationship between C and Nb+V, the composition relationship between Ni and Mn+Cu, and a Ti/N ratio and a Ca/S ratio, and combines a subsequent process design, so as to obtain a thick steel plate having excellent strength toughness, yield ratio and ultra-low temperature impact.

Further, the microstructure of the low-yield ratio high-strength-toughness thick steel plate with excellent low temperature impact toughness has reversed austenite and tempered martensite. In the microstructure, so-called reversed austenite refers to austenite that is transformed from ferrite again during tempering.

Either different from obtaining a steel material having a lower yield strength and a higher tensile strength by means of a microstructure of a soft phase combined with a hard phase in the prior art, or different from obtaining a steel plate having a higher tensile strength and a lower yield ratio by using a dual-phase steel of ferrite and martensite in the art, the technical solution of the present invention obtains a steel plate having a low yield ratio, a high strength and a good low temperature toughness by means of a microstructure of tempered martensite and reversed austenite.

Furthermore, the phase proportion of the above-mentioned reversed austenite is 3-10%.

Further, the thickness of the low-yield ratio high-strength-toughness thick steel plate with excellent low temperature impact toughness of the present invention is 5-60 mm.

The present invention further provides a method for manufacturing a low-yield ratio high-strength-toughness thick steel plate with excellent low temperature impact toughness, and a steel plate having a low yield ratio, a high-strength-toughness and a good low temperature toughness can be obtained by the manufacturing method.

The method for manufacturing the low-yield ratio high-strength-toughness thick steel plate with excellent low temperature impact toughness of the present invention comprises the steps of smelting, casting, heating, two-stage rolling, quenching, cooling after the quenching, and tempering.

Further, in the above-mentioned casting step, a pouring casting process is used, the pouring casting temperature is 1490-1560° C., and the superheat degree of the pouring casting is controlled in 8-35° C.

The use of the above-mentioned casting temperature and the control of a certain superheat degree can effectively facilitate inclusions to float, thereby ensuring the quality of plate slab.

Further, in the above-mentioned heating step, the heating temperature is controlled at 1080-1250° C., and after the center of plate slab reaches the temperature, the temperature is maintained for 60-300 min.

The heating step is principally a process in which carbonitrides dissolve and austenite grains grow. Carbides or carbonitrides formed from carbide-forming elements such as Nb, V, Ti, Cr and Mo are partially dissolved in steel, and the atoms of alloy elements are solid dissolved in austenite by way of diffusion. The austenitization of the steel plate can be achieved between the heating temperatures of 1080-1250° C.

Further, in the above-mentioned two-stage rolling step, the single pass reduction rate of rolling in a recrystallization zone is controlled at ≥8%, and the total reduction rate of rolling in the recrystallization zone is controlled at ≥50%; and the single pass reduction rate of rolling in a non-recrystallization zone is controlled at ≥12%, and the total reduction rate of rolling in the non-recrystallization zone is controlled at ≥50%.

Rolling is carried out after the heating, and in the rolling step, part of the carbonitrides nucleate and grow at defects due to a strain-induced precipitation effect so as to refine the final grains, thereby improving the mechanical properties of the steel plate. The heated steel plate is treated using a two-stage rolling technique, wherein none of the single pass reduction rate of rolling in the recrystallization zone, the total reduction rate of rolling in the recrystallization zone, the single pass reduction rate of rolling in the non-recrystallization zone and the total reduction rate of rolling in the non-recrystallization zone is limited by an upper limit; that is to say, if equipment and production conditions permit, the above-mentioned parameters may be as large as possible with the proviso that the limitation of the lower limits is satisfied. Controlling the single pass reduction rate of rolling in the recrystallization zone at ≥8% and the total reduction rate of rolling in the recrystallization zone at ≥50% can cause austenite grains to be fully deformed and recrystallized so as to refine the grains. Controlling the single pass reduction rate of rolling in the non-recrystallization zone at ≥12% and the total reduction rate of rolling in the non-recrystallization zone at ≥50% is conducive to fully improving the dislocation density, which on the one hand promotes Nb, V etc., to form fine dispersive precipitation at dislocation lines and zero dislocations, and on the other hand provides sufficient nucleation sites for phase transformation nucleation.

Further, in the above-mentioned two-stage rolling step, the initial rolling temperature of rolling in the non-recrystallization zone is controlled at 800-860° C. and the final rolling temperature is controlled at 770-840° C., which is conducive to improving the dislocation density of the steel plate and refining the final structure, so as to form a steel plate having a high strength and a higher toughness.

Furthermore, in the above-mentioned quenching step, a water quenching process is used, the temperature entering water is 750-820° C., the cooling rate is 10-150° C./s, and the final cooling temperature is room temperature to 350° C.

In the above-mentioned quenching step, due to the comprehensive effect of the alloy elements such as Cr, Mn, Mn and Ni in the steel plate, a refined martensite structure is formed. The C element in the martensite structure can lead to lattice distortion, which greatly improves the yield strength and tensile strength of the steel plate.

Furthermore, in the cooling step after the above-mentioned quenching, with regard to a steel plate having a thickness of ≤30 mm, the steel plate is cooled to room temperature by means of stack cooling or a cooling bed; and with regard to a steel plate having a thickness of >30 mm, the steel plate is cooled to room temperature by means of stack cooling or temperature-maintaining slow cooling.

Since the thickness of the thick steel plate of the present invention is in a range of 5-60 mm, it is preferable to use different cooling methods for steel plates of different thicknesses.

Furthermore, in the above-mentioned tempering step, the tempering temperature is controlled at 650-720° C., and after the center of plate slab reaches the tempering temperature, the temperature is maintained for 10-180 min.

The steel plate after having been cooled is subjected to the tempering step at a specified temperature. In the process of tempering, the following series of changes occur due to the various alloy elements in the composition: 1) the alloy elements of Ni and Mn are conducive for the stabilization of austenite, and the tempering temperature is closely related to the contents of Ni and Mn in the design of the alloy composition. If the tempering temperature is too low, reversed austenite cannot be formed, and the design purpose of a low yield ratio cannot be achieved; and if the tempering temperature is too high, the strength of the steel plate will be reduced significantly, which can neither achieve a high strength, nor can it achieve a low yield ratio. 2) In the tempering process, Nb, V and Ti form carbonitrides with C and N. If the tempering temperature is too high, carbonitrides will be coarsened significantly, which reduces the low temperature impact toughness, so that the steel plate cannot achieve a good low temperature impact toughness at an extremely low temperature; and if the tempering temperature is too low, the precipitation of Nb, V and Ti will be insufficient, which makes a lower contribution to strength. 3) ε-Cu precipitation formed in the tempering process can inhibit the movement of dislocations in the steel plate and improve the strength of the steel plate. If the tempering temperature is lower, Cu cannot be fully precipitated, which makes a reduced contribution to the strength of the steel plate is reduced. 4) In the tempering process, the dislocations in the steel may be annihilated, the dislocation density decreases, and the number of small angle grain boundaries may be reduced, resulting in a reduced strength of the steel plate. The higher the tempering temperature, the more serious the degree of reduction of the dislocation density, and thus the more obvious the strength of the steel plate is reduced. 5) After the tempering, complex carbides of Cr and Mo in combination with C may be formed. In conjunction with the above-mentioned effect of the tempering step, the composition system of the present invention and the microstructure formed after the heating, rolling and cooling steps, the tempering temperature is set to 650-720° C., and the continued temperature maintaining time after the center of the steel plate reaches the specified temperature is 10-180 min.

The low-yield ratio high-strength-toughness thick steel plate with excellent low temperature impact toughness of the present invention has a higher tensile strength, wherein the tensile strength is ≥1100 MPa, the yield strength is ≥690 Mpa and the elongation is ≥14%.

Moreover, the low-yield ratio high-strength-toughness thick steel plate with excellent low temperature impact toughness of the present invention has a lower yield ratio, wherein the yield ratio is lower than 0.65.

Moreover, the low-yield ratio high-strength-toughness thick steel plate with excellent low temperature impact toughness of the present invention has a good low temperature impact toughness, wherein the low temperature impact work at −84° C. is greater than 60 J.

The thickness specification of the low-yield ratio high-strength-toughness thick steel plate with excellent low temperature impact toughness of the present invention can reach 5-60 mm.

A steel plate having a high tensile strength, a low yield ratio, a good low temperature toughness and a thickness in an appropriate range can be produced by the method for manufacturing a low-yield ratio high-strength-toughness thick steel plate with excellent low temperature impact toughness of the present invention of the present invention.

Moreover, the production using the method for manufacturing a low-yield ratio high-strength-toughness thick steel plate with excellent low temperature impact toughness of the present invention of the present invention can be carried out steadily in medium and thick steel plate production lines.

DETAILED DESCRIPTION OF EMBODIMENTS

The low-yield ratio high-strength-toughness thick steel plate with excellent low temperature impact toughness and the manufacturing method thereof according to the present invention are further explained and described below according to specific examples; however, the explanation and description do not constitute an undue limitation to the technical solution of the present invention.

Low-yield ratio high-strength-toughness thick steel plates with excellent low temperature impact toughness of Examples A1-A6 are manufactured according to the following steps, wherein the microstructures of the resulting thick steel plates have reversed austenite and tempered martensite in a phase proportion of 3-10%;

1) Smelting: molten steel is smelted and refined, with the proportions in percentage by mass of various chemical elements in the steel being as shown in Table 1;

2) Casting: a pouring casting process is used, with the pouring casting temperature being 1490-1560° C., and the superheat degree of the pouring casting being controlled in 8-35° C.;

3) Heating: the heating temperature is controlled at 1080-1250° C., and after the center of plate slab reaches the temperature, the temperature is maintained for 60-300 min;

4) Two-stage rolling step:

4i) Rolling in recrystallization zone: the single pass reduction rate of rolling in the recrystallization zone is controlled at ≥8%, and the total reduction rate of rolling in the recrystallization zone is controlled at ≥50%; and the temperature of the recrystallization zone is common in the art, wherein generally, the initial rolling temperature is 1050-1220° C., and the final rolling temperature is 880° C. or higher; and 4ii) Rolling in non-recrystallization zone: the initial rolling temperature is 800-860° C., the final rolling temperature is 770-840° C., the single pass reduction rate of rolling in the non-recrystallization zone is controlled at ≥12%, and the total reduction rate of rolling in the non-recrystallization zone is controlled at ≥50%;

5) Quenching: a water quenching process is used, the temperature entering water is 750-820° C., the cooling rate is 10-150° C./s, and the final cooling temperature is room temperature to 350° C.;

6) Cooling after the quenching: with regard to a steel plate having a thickness of ≤30 mm, the steel plate is cooled to room temperature by means of stack cooling or a cooling bed; and with regard to a steel plate having a thickness of >30 mm, the steel plate is cooled to room temperature by means of stack cooling or temperature-maintaining slow cooling; and 7) Tempering: the tempering temperature is controlled at 650-720° C., and after the center of plate slab reaches the tempering temperature, the tempering continues to be maintained for 10-180 min.

For the specific process parameters involved in the various steps of the above-mentioned manufacturing method in detail, reference can be made to Table 2.

Table 1 lists the contents in percentage by mass of the various chemical elements for making the thick steel plates of Examples A1-A6.

TABLE 1

(wt. %, the balance being Fe and other inevitable impurities)

| Serial number | C | Si | Mn | S | Cr | Mo | Nb | Ni | Ti | Al | N | O | Ca | Cu | V | Plate thickness (mm) |
|---|---|---|---|---|---|---|---|---|---|---|---|---|---|---|---|---|
| A1 | 0.05 | 0.3 | 2.2 | 0.001 | 0.55 | 0.50 | 0.02 | 3.6 | 0.01 | 0.01 | 0.002 | 0.003 | 0.0035 | 0.0 | 0.05 | 10 |
| A2 | 0.06 | 0.2 | 2.1 | 0.001 | 0.35 | 0.65 | 0.03 | 4.0 | 0.02 | 0.02 | 0.003 | 0.002 | 0.0025 | 0.5 | 0.06 | 20 |
| A3 | 0.08 | 0.15 | 2.0 | 0.001 | 0.65 | 0.45 | 0.04 | 4.5 | 0.02 | 0.05 | 0.004 | 0.001 | 0.0025 | 0.6 | 0.06 | 30 |
| A4 | 0.09 | 0.4 | 1.8 | 0.002 | 0.70 | 0.20 | 0.05 | 5.0 | 0.03 | 0.05 | 0.004 | 0.001 | 0.0035 | 0.7 | 0.03 | 40 |
| A5 | 0.10 | 0.25 | 1.7 | 0.003 | 0.40 | 0.35 | 0.05 | 5.0 | 0.04 | 0.06 | 0.005 | 0.004 | 0.0035 | 0.8 | 0.01 | 50 |
| A6 | 0.11 | 0.1 | 1.6 | 0.001 | 0.20 | 0.80 | 0.06 | 5.5 | 0.05 | 0.08 | 0.006 | 0.002 | 0.0035 | 1.0 | 0.1 | 60 |

Table 2 lists the process parameters of the method for manufacturing the thick steel plates in Examples A1-A6.

TABLE 2

| | | | | | Two-stage rolling | | | |
|---|---|---|---|---|---|---|---|---|
| | | Casting Superheat | Heating | | Rolling in recrystallization zone | | Rolling in non-recrystallization zone | |
| Serial number | Pouring casting temperature (° C.) | degree of casting (° C.) | Heating temperature (° C.) | Heating maintaining time (min) | Single pass reduction (%) | Total reduction rate (%) | Initial rolling temperature (° C.) | Final rolling temperature (° C.) |
| A1 | 1560 | 35 | 1080 | 300 | 8-60 | 90 | 860 | 830 |
| A2 | 1545 | 28 | 1100 | 250 | 8-50 | 80 | 860 | 840 |
| A3 | 1525 | 20 | 1150 | 200 | 8-40 | 70 | 840 | 820 |
| A4 | 1510 | 15 | 1180 | 150 | 8-30 | 60 | 830 | 810 |
| A5 | 1500 | 13 | 1230 | 100 | 8-25 | 50 | 820 | 800 |
| A6 | 1490 | 8 | 1250 | 60 | 8-20 | 50 | 800 | 770 |

| | Two-stage rolling Rolling in non-recrystallization zone | | Quenching | | | Tempering | |
|---|---|---|---|---|---|---|---|
| Serial number | Single pass reduction (%) | Total reduction rate (%) | Temperature entering water (° C.) | Cooling rate (° C./s) | Final cooling temperature (° C.) | Tempering temperature (° C.) | Continued temperature maintaining time (min) |
| A1 | 12-50 | 75 | 770 | 150 | 350 | 650 | 10 |
| A2 | 12-50 | 70 | 820 | 70 | 250 | 670 | 30 |
| A3 | 12-30 | 60 | 800 | 30 | 200 | 720 | 60 |
| A4 | 12-25 | 60 | 790 | 20 | 150 | 700 | 90 |
| A5 | 12-20 | 50 | 780 | 15 | 100 | 680 | 120 |
| A6 | 12-20 | 60 | 750 | 10 | Room temperature | 660 | 180 |

The mechanical properties of the above-mentioned thick steel plates as obtained after testing are shown in Table 3, and Table 3 lists the various mechanical property parameters of the thick steel plates in Examples A1-A6.

Table 3 lists the various mechanical property parameters of the thick steel plates in Examples A1-A6.

TABLE 3

| Serial number | Yield strength (MPa) | Tensile strength (MPa) | Yield ratio | Rate of elongation (%) | Impact work Akv [−84° C.] (J) |
|---|---|---|---|---|---|
| A1 | 723 | 1130 | 0.64 | 14 | 89 |
| A2 | 770 | 1222 | 0.63 | 15 | 97 |
| A3 | 781 | 1240 | 0.63 | 15 | 115 |
| A4 | 804 | 1297 | 0.62 | 15 | 91 |
| A5 | 813 | 1311 | 0.62 | 15 | 88 |
| A6 | 751 | 1173 | 0.64 | 14 | 74 |

It can be seen from Table 3 that the thick steel plates of Examples A1-A6 herein have a yield ratio of ≤0.64, a tensile strength of ≥1130 MPa, a yield strength of ≥723 MPa, a rate of elongation of ≥14% and a Charpy impact work Akv. (−84° C.) of ≥74 J, which thus indicates that the thick steel plates of Examples A1-A6 have all of a ultra-low yield ratio, higher strengths (a yield strength and a tensile strength), and a good ultra-low temperature toughness, and thus can be applied to extremely cold areas and to structures and equipment having higher requirements for safety.

It is to be noted that the examples listed above are merely specific examples of the present invention, and obviously the present invention is not limited to the above examples and can have many similar changes. All variants that would be directly derived from or associated with the contents disclosed in the present invention by a person skilled in the art should fall within the scope of protection of the present invention.

The invention claimed is:

1. A low-yield ratio high-strength-toughness thick steel plate with excellent low temperature impact toughness, characterized in that the contents in percentage by mass of chemical elements of the thick steel plate are:

0.05-0.11% of C, 0.10-0.40% of Si, 1.60-2.20% of Mn, S≤0.003%, 0.20-0.70% of Cr, 0.20-0.80% of Mo, 0.02-0.06% of Nb, 3.60-5.50% of Ni, 0.01-0.05% of Ti, 0.01-0.08% of Al, 0<N≤0.0060%, 0<O≤0.0040%, 0≤Ca 0.0045%, and the balance being Fe and inevitable impurities;

with Ti/N≥3.0;

with Ni+Mn≥5.5 being further satisfied;

wherein the steel plate has a thickness of 5-60 mm, a tensile strength of ≥1100 MPa, a yield strength of ≥690 MPa, an elongation of ≥14%, a yield ratio of lower than 0.65, and a low temperature impact work at −84° C. of greater than 60 J;

wherein the steel plate's microstructure consists of reversed austenite and tempered martensite; and wherein the phase proportion of the reversed austenite is 3-10%.

2. The low-yield ratio high-strength-toughness thick steel plate with excellent low temperature impact toughness of claim 1, characterized by further satisfying 1.2≤Ca/S≤3.5.

3. The low-yield ratio high-strength-toughness thick steel plate with excellent low temperature impact toughness of claim 1, characterized by further comprising at least one of 0.01-0.10% of V and 0.50-1.00% of Cu.

4. The low-yield ratio high-strength-toughness thick steel plate with excellent low temperature impact toughness of claim 3, characterized by further satisfying 0.45C≤Nb+V≤1.55C where V is contained.

5. The low-yield ratio high-strength-toughness thick steel plate with excellent low temperature impact toughness of claim 3, characterized by further satisfying Ni≥1.45(Mn+Cu) where Cu is contained.

6. A method for manufacturing the low-yield ratio high-strength-toughness thick steel plate with excellent low temperature impact toughness of claim 1, characterized by comprising the steps of smelting, casting, heating, two-stage rolling, quenching, cooling after the quenching, and tempering.

7. The manufacturing method of claim 6, characterized in that in said casting step, a pouring casting process is used, the pouring casting temperature is 1490-1560° C., and the superheat degree of the pouring casting is controlled in 8-35° C.

8. The manufacturing method of claim 6, characterized in that in said heating step, the heating temperature is controlled at 1080-1250° C., and after the center of plate slab reaches the temperature, the temperature is maintained for 60-300 min.

9. The manufacturing method of claim 6, characterized in that in said two-stage rolling step, the single pass reduction rate of rolling in a recrystallization zone is controlled at ≥8%, and the total reduction rate of rolling in the recrystallization zone is controlled at ≥50%; and the single pass reduction rate of rolling in a non-recrystallization zone is controlled at ≥12%, and the total reduction rate of rolling in the non-recrystallization zone is controlled at ≥50%.

10. The manufacturing method of claim 6, characterized in that in said two-stage rolling step, the initial rolling temperature of rolling in the non-recrystallization zone is controlled at 800-860° C. and the final rolling temperature is controlled at 770-840° C.

11. The manufacturing method of claim 6, characterized in that in said quenching step, a water quenching process is used, the temperature of the steel plate entering into water is 750-820° C., the cooling rate is 10-150° C./s, and the final cooling temperature is room temperature to 350° C.

12. The manufacturing method of claim 6, characterized in that in said cooling step after quenching, with regard to a steel plate having a thickness of ≤30 mm, the steel plate is cooled to room temperature by stack cooling or a cooling bed; and with regard to a steel plate having a thickness of >30 mm, the steel plate is cooled to room temperature by stack cooling or temperature-maintaining slow cooling.

13. The manufacturing method of claim 6, characterized in that in said tempering step, the tempering temperature is controlled at 650-720° C., and after the center of plate slab reaches the tempering temperature, the temperature is maintained for 10-180 min.

* * * * *